United States Patent [19]

Hirano

[11] Patent Number: 4,590,893

[45] Date of Patent: May 27, 1986

[54] COOLANT LEVEL SENSOR ARRANGEMENT FOR INTERNAL COMBUSTION ENGINE

[75] Inventor: Yoshinori Hirano, Yokohama, Japan

[73] Assignee: Nissan Motor Co., Ltd., Yokohama, Japan

[21] Appl. No.: 645,629

[22] Filed: Aug. 30, 1984

[30] Foreign Application Priority Data

Sep. 2, 1983 [JP] Japan ..... 58-161601

[51] Int. Cl.[4] ..... F01P 3/22

[52] U.S. Cl. ..... 123/41.21; 123/41.27; 123/41.44; 340/620

[58] Field of Search ..... 123/41.2, 41.21, 41.24–41.27, 123/41.44, 41.46, 41.47, 41.02; 340/618, 620; 374/145

[56] References Cited

U.S. PATENT DOCUMENTS 1,787,562 1/1931 Barlow ..... 123/41.44
1,792,520 2/1931 Weinhardt ..... 123/41.44
3,845,464 10/1974 Engel ..... 340/59

FOREIGN PATENT DOCUMENTS 5632028 4/1981 Japan ..... 123/41.24
786437 4/1955 United Kingdom .
1433687 4/1976 United Kingdom ..... 123/41.15

OTHER PUBLICATIONS

European Search Report.

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to protect a level sensor from splashes, foaming and precipitation which occurs within the coolant jacket of an engine wherein the coolant is permitted to boil and the vapor used a vehicle for removing heat from the engine, the sensor is arranged within a shielding structure which becalms the environment immediately surrounding the sensor thus enabling accurate level control.

6 Claims, 5 Drawing Figures

COOLANT LEVEL SENSOR ARRANGEMENT FOR INTERNAL COMBUSTION ENGINE

BACKGROUND OF THE INVENTION

1. Field of the Invention

The present invention relates generally to an internal combustion engine of the type wherein the coolant is boiled, so as to make use of the latent heat of vaporization thereof, and the coolant vapor used as a vehicle for removing heat from the engine, and more specifically to an improved coolant level sensor arrangement therefor.

2. Description of the prior art

In currently used "water cooled" internal combustion engines, the engine coolant (liquid) is forcefully circulated by a water pump through a circuit including the engine coolant jacket and a radiator (usually fan cooled). However, in this type of system a drawback is encountered in that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to achieve this, a flow rate of 167 1/min (viz., $4000-60\times\frac{1}{4}$) must be produced by the water pump. This of course undesirably consumes a number of horsepower.

In order to overcome this problem it has been proposed to boil the coolant and use the vapor as a heat transfer medium (thus taking advantage of the latent heat of evaporation of the coolant). Examples of such arrangements are found in U.S. Pat. No. 1,376,086 issued on Apr. 25, 1921 in the name of Fairman and in European Patent Application Publication No. 0059423 published on Sept. 8, 1982.

However, with such arrangements a problem has been encountered in that in zones of high heat flux, such as in the immediate vicinity of the combustion chamber, exhaust port and valve, upon boiling of the coolant, extraordinarily large gas bubbles are sometimes produced. These bubbles tend to displace liquid coolant from particular areas of the coolant jacket which, due to the momentary lack of coolant, rapidly elevate in temperature giving rise to the formation of localized "hot spots". These so called "hot spots" due to their elevated temperatures tend to promote the formation of further large gas bubbles which continue to displace coolant and thus induce localized "dry outs" within the coolant chamber. This of course leads to knocking and/or thermal damage (e.g. piston seizure).

To obviate this problem it is necessary to dispose a liquid coolant level sensor relatively close to the zones of high heat flux wherein the above mentioned localized "dry outs" tend to occur so as to permit quick ascertainment of such conditions. However, due to the bumping and frothing of the coolant which accompanies the vigorous boiling in the zones of high heat flux, the level indication by such sensors is often erroneous due to the deluge of waves, foam and rain-like precipation of coolant droplets which occurs under such conditions.

SUMMARY OF THE INVENTION

It is an object of the present invention to provide a coolant level sensor arrangement for a cooling system for use with an internal combustion engine or the like, wherein the coolant is boiled and the vapor used as a heat transfer medium, which can accurately detect the level of coolant in the coolant jacket even in zones wherein vigorous boiling occurs.

In brief, these objects are fullfilled by an arrangement wherein, in order to protect a level sensor from splashes, foaming and precipitation which occurs within the coolant jacket of an engine wherein the coolant is permitted to boil and the vapor used as a vehicle for removing heat from the engine, the sensor is arranged within a shielding structure which becalms the environment immediately surrounding the sensor and enables accurate level control.

More specifically the present invention takes the form of a cooling system for a device having a structure subject to heating, which is characterized by a coolant jacket formed about the heated structure into which coolant is introduced in liquid form and discharged in gasesous form, a level sensor disposed within the coolant jacket in close proximity of the heated structure for sensing the level of liquid coolant at a first predetermined level which is higher than the heated structure, an arrangement which becalms the environment immediately surrounding the level sensor and which attenuates movement of the liquid coolant which would otherwise tend to induce erronous level indications by the level sensor, and a pump responsive to the level sensor for pumping liquid coolant into the coolant jacket in a manner to maintain the level of liquid coolant at the first predetermined one.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
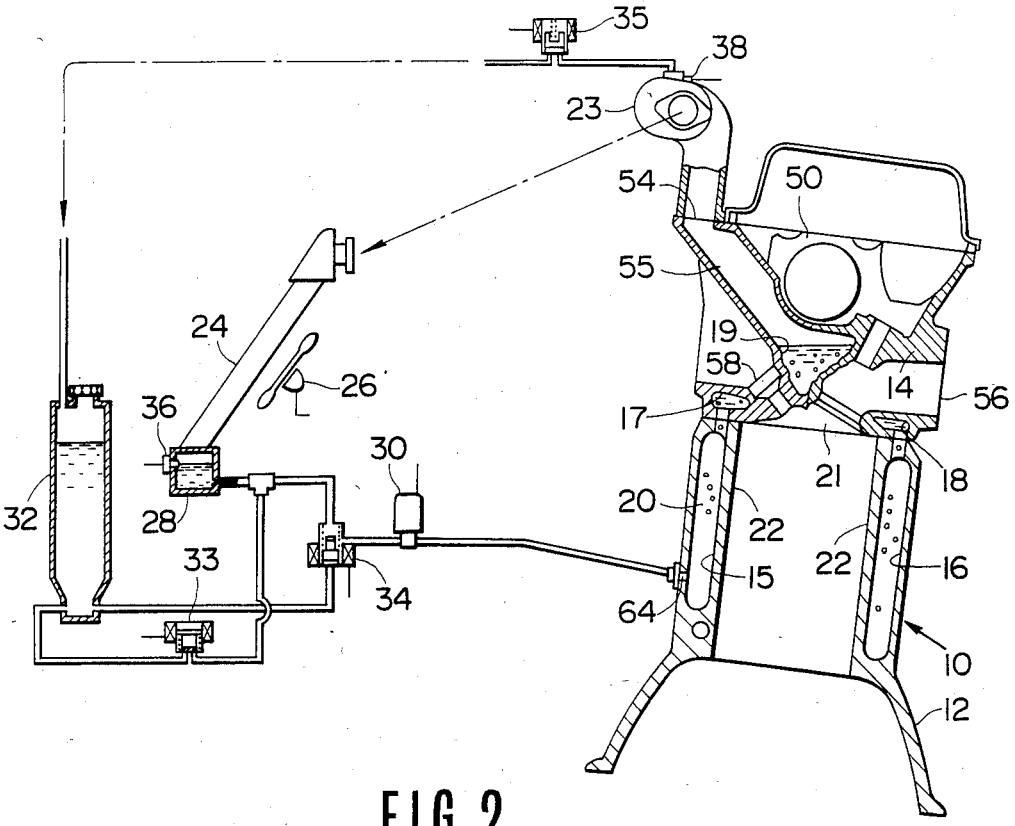
FIG. 1 is a schematic diagram of an engine system in which embodiments of the present invention find application and wherein the section shown therein is take along section line I—I of FIG. 3.

FIG. 1 shows an engine system in which the present invention finds application. This system includes an internal combustion engine 10 which includes a cylinder block 12 and cylinder head 14. The cylinder head and block are formed with a plurality of cavities 15–19, as shown, which define a coolant jacket 20 about the structure defining the combustion chamber 21 and cylinder walls 22. In this system the liquid coolant in the coolant jacket is permitted to boil and the vapor transmitted via manifold 23 and suitable hosing (shown in phantom) to a radiator 24 wherein it is condensed back to its liquid form. In order to control the rate of condensation in the radiator 24, a fan 26 is disposed as shown. This fan 26 is selectively energized in a manner which may be varied in accordance with one or more operating parameters of the engine. The condenser or radiator 24 is arranged to be normally empty of liquid coolant which is collected in a small collection tank or reservior 28 at the bottom of the radiator. A pump 30 is arranged to return the condensed liquid collant back to the coolant jacket under the control of a level sensor (not shown in this figure).

In this system it is preferable, from the point of engine longevity, to maintain the coolant at a level above the structure which defines the combustion chamber or chambers 21 of the engine 10. It is further preferable to facilitate the collection of the coolant vapor to provide a "vapor" space within the coolant jacket immediately above the liquid coolant level. This, in combination with the provision of the manifold 23, also minimizes the amount of liquid coolant which tends to reach the radiator 24. This is desirable from the point of maintaining the interior of the radiator 24 "dry" and thus maximizing the surface area via which the latent heat of vaporization may be released to the ambient atmosphere.

The construction and arrangement of the sensor (or sensors) via which this function is accomplished will be made clear hereinafter.

The engine system further includes a coolant reservoir 32 and electromagnetic valves 33–35. The electromagnetic valves are operated in conjunction with second and third level sensors 36, 38. For a description of the function and operation of the above mentioned sensors and valves, reference is made to copending U.S. patent application Ser. No. 602,451 filed in Apr. 20, 1984 in the name of Hayashi (or the corresponding European Patent Application No. 84105536.1 filed on May 15, 1984), the disclosure of which is hereby incorporated by reference thereto. This document describes in detail the operation of the valves wherein when the engine stops, the cooling circuit of the engine (defined by the coolant jacket, radiator and interconnecting conduiting) is placed in an open circuit state wherein communication with the reservoir is permitted in a manner that as the coolant vapor within the cooling circuit condenses, the negative pressure which develops therein inducts liquid coolant from the reservoir. In this manner it is possible to essentially fill the cooling circuit with liquid coolant when the engine is not in use and thus eliminate the presence of a negative pressure which would otherwise invite contaminating air to leak into the system. When the engine is started, the operation of the valves is such as to permit the coolant which is introduced when the engine is shut-down to be re-displaced out to the reservoir until the appropriate amount of coolant is contained in the cooling circuit. The cooling system is thereafter sealed to assume a hermetically closed circuit state where communication between the reservoir and the ambient atmosphere is prevented.

Figure 2:
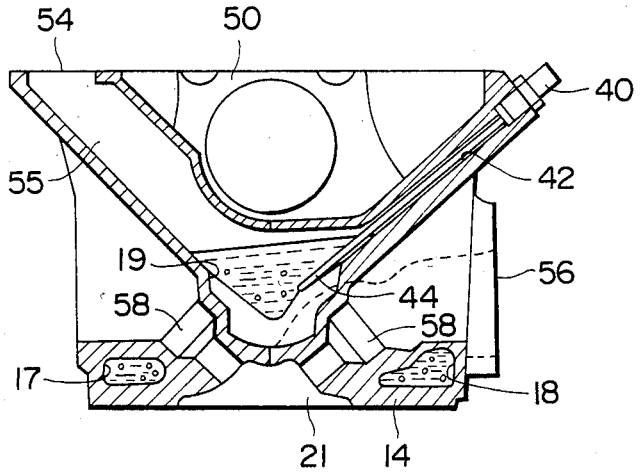
FIG. 2 is a sectional elevation of the cylinder head shown in FIG. 1 (taken along section line II—II of FIG. 3) showing a first embodiment of the present invention.

FIG. 2 shows in detail the level sensor arrangement which characterizes a first embodiment of the present invention. As shown, in this embodiment the level sensor 40 which controls the operation of pump 30 is disposed in an elongate small diameter bore 42 formed in the cylinder head 14. This level sensor 40 includes a section which may be threaded into a tapped large diameter portion of the bore 42 and an elongate probe-like member 44 extending therefrom. This sensor may be of the float/reed switch type, the type wherein the output varies with the charge in electrostatic capacity developed between two or more electrodes, the type wherein the output varies with conductivity, an untrasonic type, or the like.

In this embodiment, due to the location of the probe 44 within the bore 42 the sensing element is shielded from the wave-like movement and foaming of the coolant produced by the boiling action of the coolant and from rain drop-like precipitation of coolant which falls from the upper walls of the cylinder head structure. Furthermore, due to its position in close proximity to the combustion chamber(s) 21, any momentary cavitating or localized dry-outs may be quickly detected and the necessary energization of pump 30, be realized.

Figure 3:
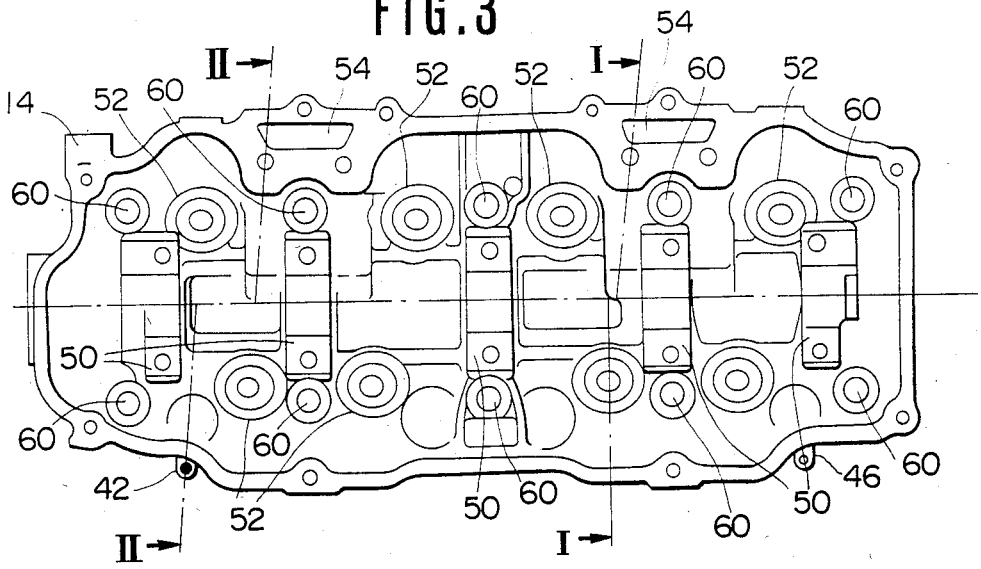
FIG. 3 is a top plan view of the cylinder head shown in FIG. 1.
Figure 4:
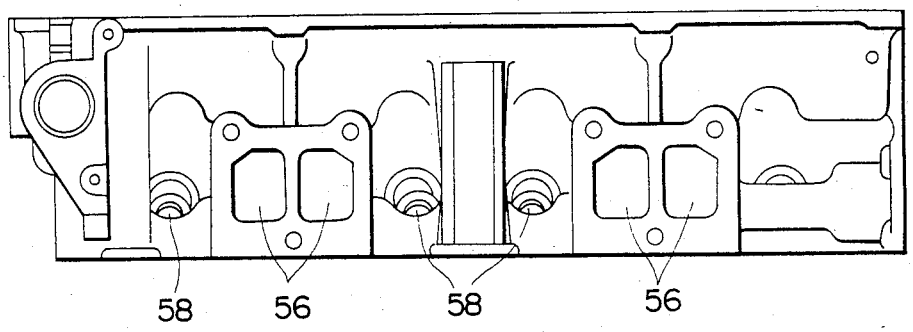
FIG. 4 is a side elevation of the cylinder head shown in FIG. 3.
Figure 5:
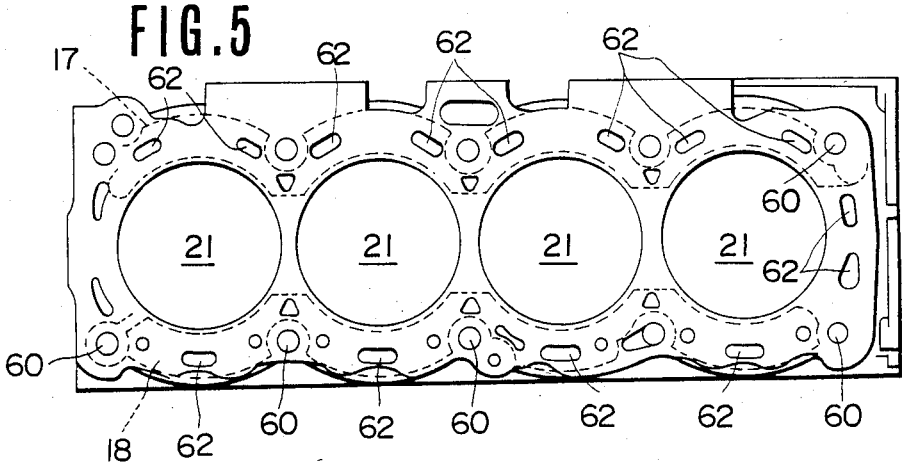
FIG. 5 is a bottom plan view of the cylinder head shown in FIGS. 3 and 4.

A second embodiment of the present invention features a second level sensor. This level sensor is arranged in a bore 46 (see FIG. 3) in essentially the same manner as the first sensor. With this arrangement it is possible to arrange for one sensor to indicate an upper level and the other a lower level. This makes it possible to energize the pump upon the coolant level falling to the lower level and maintain same energized until the coolant level has risen to the upper level. This of course obviates the tendency for the pump to hunt on and off and introduce hysteresis into the control. Alternatively, the same control may be achieved with a single sensor by using two different level indications.

In FIGS. 1 to 5, the illustrated cylinder head 14 includes a series of rocker shaft bearings 50, spring seats 52, and vapor outlet ports 54 through which gaseous coolant is discharged into manifold 23. The cylinder head 14 further includes exhaust ports 56 formed in the side thereof, bores 58 for receiving spark plugs and cavities which cooperate with the cylinder block 12 to form combustio chambers 21. Elongate bores 60 receive head bolts (not shown) which secure the head to the block. Formed along each side of the cylinder head 14 are the cavities 17, 18 which communicate with the chamber-like section or cavity 19 of the coolant jacket located above the combustion chambers 21. Ports 62 formed in the lower deck of the cylinder head serve to establish fluid communication between the cavities formed in the cylinder head (17–19) and those (15, 16) formed in the cylinder block 12.

With this arrangement the liquid coolant which is introduced into the cylinder block 12 through port 64 rises up through the ports 62 into the cavities 17, 18 of the cylinder head wherein it is vaporized and conveyed to the radiator 24.

Although the embodiments of the present invention have been disclosed in connection with a four cylinder in-line reciprocating type combustion engine it will be appreciated that the present invention can be equally applied to other forms of engines and/or devices which required cooling and are equipped with cooling systems of the above described nature.

What is claimed is:

1. In a cooling system for a device having a structure subject to heating a coolant jacket formed about said heated structure into which coolant is introduced in liquid form and discharged in gaseous form;

a radiator in which gaseous coolant is condensed to its liquid form;

vapor transfer means for conveying gaseous coolant from said coolant jacket to said radiator;

a liquid coolant return conduit leading from said radiator to said coolant jacket, said coolant jacket, said radiator, said vapor transfer means and said liquid coolant return conduit defining a cooling circuit;

a reservoir containing liquid coolant, said reservoir being discrete from the cooling circuit;

valve and conduit means for selectively placing the cooling circuit in a hermetically sealed closed circuit condition and for controlling communication between said radiator and the cooling circuit in a manner which permits coolant to be inducted into the cooling circuit from the reservoir when the engine is stopped;

a level sensor disposed within said coolant jacket in close proximity of said heated structure for sensing the level of liquid coolant at a first predetermined level which is higher than said heated structure;

an arrangement which becalms the environment immediately surrounding said level sensor and which attenuates movement of the liquid coolant which would otherwise tend to induce erroneous level indications by said level sensor; and a pump responsive to said level sensor for pumping liquid coolant into said coolant jacket in a manner to maintain the level of liquid coolant at the first predetermined one.

2. A cooling system as claimed in claim 1, wherein said coolant jacket includes an inlet port and an outlet port, and wherein said sensor is spaced from said outlet port.

3. A cooling system as claimed in claim 1, wherein said device is an internal combustion engine and said heated structure is the structure of said engine which defines a combustion chamber of said engine.

4. A cooling system for a device having a structure subject to heating, comprising:

a coolant jacket formed about said heated structure into which coolant is introduced in liquid form and discharged in gaseous form;

a first level sensor disposed within said coolant jacket in close proximity of said heated structure for sensing the level of liquid coolant at a first predetermined level which is higher than said heated structure;

a second level sensor disposed in close proximity of said heated structure for sensing the level of liquid coolant at a second predetermined level which is lower than said first predetermined level;

an arrangement which becalms the environment immediately surrounding said level sensors and which attenuates movement of the liquid coolant which would otherwise tend to induce erroneous level indications by said level sensors; and a pump responsive to said level sensors for pumping liquid coolant into said coolant jacket in a manner to maintain the liquid coolant at the first predetermined level.

5. A cooling system as claimed in claim 4, wherein said second sensor is arranged to sense the level of liquid coolant at a second predetermined level which is higher than said heated structure and said first predetermined level.

6. A cooling system for an internal combustion engine having a combustion chamber subject to heating, comprising:

a coolant jacket formed about the combustion chamber into which coolant is introduced in liquid form and discharged in gaseous form;

a level sensor disposed within said coolant jacket in close proximity of said combustion chamber for sensing the level of liquid coolant at a first predetermined level which is higher than said combustion chamber;

an arrangement which becalms the environment immediately surrounding said level sensor and which attenuates movement of the liquid coolant which would otherwise tend to induce erroneous level indications by said level sensor; and a pump responsive to said level sensor for pumping liquid coolant into said coolant jacket in a manner to maintain the liquid coolant at the first predetermined level;

wherein said engine includes a cylinder head and a cylinder block, said cylinder head and said cylinder block being formed with fluidly interconnected cavities which define said coolant jacket and wherein said bacalming arrangement takes the form of an elongate bore formed in said cylinder head and in which said sensor is disposed.

* * * * *